US005199563A

United States Patent [19]

Goodman

[11] Patent Number: 5,199,563

[45] Date of Patent: Apr. 6, 1993

[54] CUSHIONED CAMERA CASE

[76] Inventor: H. Gene Goodman, 3564 Hill Dr., Duluth, Ga. 30136

[21] Appl. No.: 811,987

[22] Filed: Dec. 23, 1991

[51] Int. Cl.[5] ..... B65D 85/38; B65D 85/30

[52] U.S. Cl. ..... 206/316.2; 206/523; 206/590; 206/592

[58] Field of Search ..... 206/316.2, 523, 524, 206/521, 305, 591, 592, 594, 316.1, 316.3, 588, 590; 294/149-152, 157

[56] References Cited

U.S. PATENT DOCUMENTS

| | | | |
|---|---|---|---|
| 538,988 | 5/1895 | Ussher | 294/150 |
| 1,116,670 | 11/1914 | Brewer | 206/521 |
| 3,017,019 | 1/1962 | Cahill | 206/591 X |
| 3,072,166 | 1/1963 | Buchholtz et al. | 206/316.2 |
| 3,923,222 | 12/1975 | Groves | 294/157 |
| 4,185,673 | 1/1980 | Daniello | 206/523 X |
| 4,805,776 | 2/1989 | Namgyal et al. | 206/523 |
| 4,824,059 | 4/1989 | Butler | 206/523 X |
| 4,923,060 | 5/1990 | Breslau | 206/316.2 |

FOREIGN PATENT DOCUMENTS

| | | | |
|---|---|---|---|
| 218378 | 11/1961 | Austria | 206/316.2 |
| 0150487 | 11/1979 | Japan | 706/316.2 |

*Primary Examiner*—Bryon P. Gehman
*Attorney, Agent, or Firm*—James A. Hinkle

[57] ABSTRACT

A cushioned camera case has a tubular body made of thick resilient material without rigid framework and having expansion sections for camera appendages and an easy-open entrance. The tubular body can be cylindrical, rectangular or cubical. The expansion sections can be orifices that are elongated or shaped and positioned for access to particular camera components for allowing certain use of cameras while in the camera cases. This invention can be produced for particular cameras and camcorders or for general use for cameras and camcorders and related items.

23 Claims, 3 Drawing Sheets

FIG.7
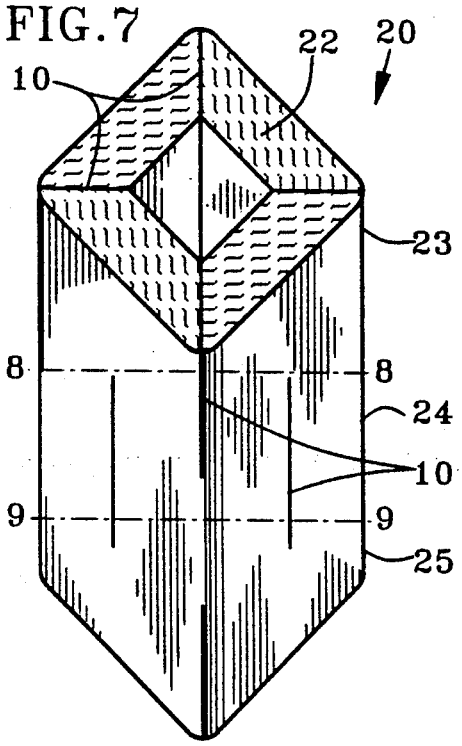
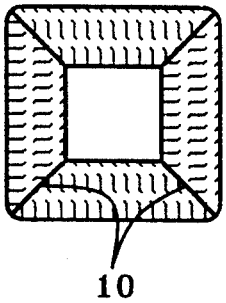
FIG.8
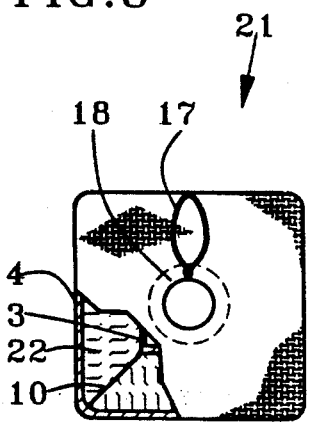
FIG.9
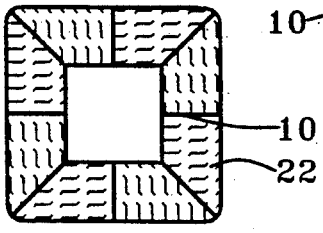
FIG.10
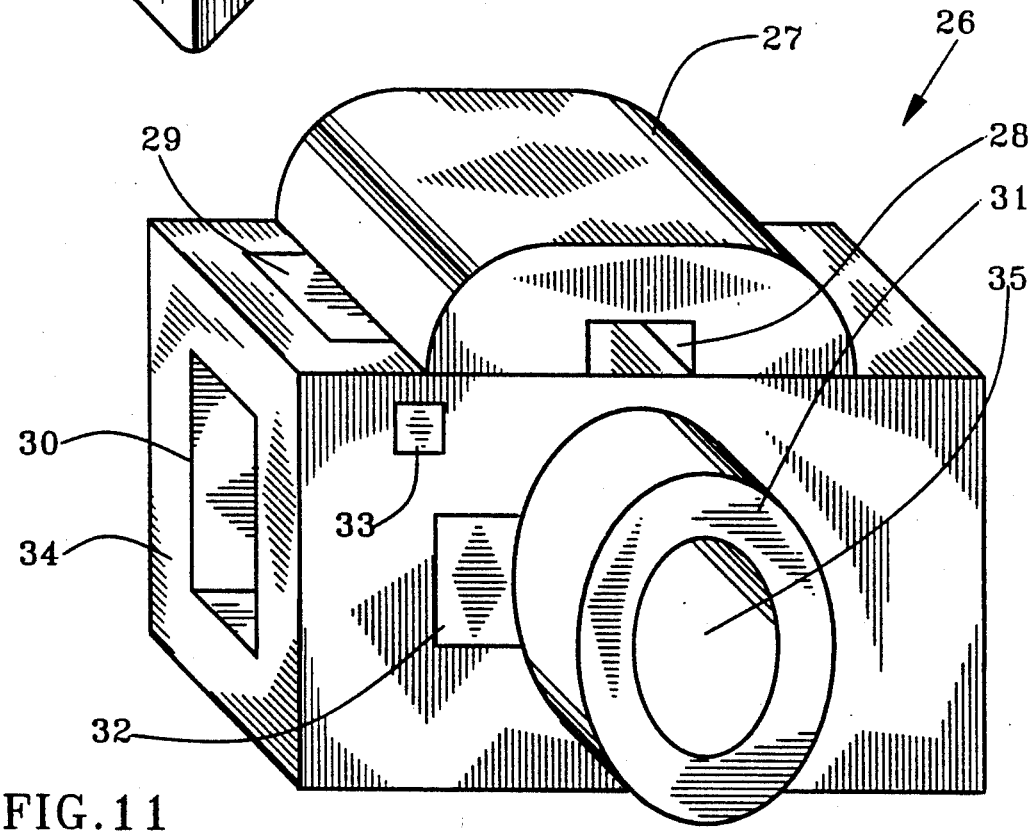
FIG.11

CUSHIONED CAMERA CASE

BACKGROUND OF THE INVENTION

I. Field of the Invention.

This invention relates to cushioned camera cases. In particular it is a camera case without rigid framework to damage cameras when being dropped or jostled and having sufficient cushion to protect a camera against impact involved in active conditions in which cameras are beginning to be used and yet have them easily and conveniently accessible.

II. Description of the Prior Art.

There are many and varied camera cases in use. However, none provide sufficient cushion in combination with convenience for sufficient protection in the active conditions in which increasingly-compact cameras are being used. The trend in cameras is to make them as small and light as possible for convenient and yet steady one-handed use. At the same time, more automation and more optional controls are being added. This makes all surface area of cameras either a section for controls or a hand-grasping surface. Although construction materials are being made tough for the active use-conditions, toughness adds both size and weight. Size for toughness is competitive with size for hand-grasping, for lenses, for automation and for control features. It is necessary to protect the controls and lenses as well as the camera housing. It is equally important for the camera to be easily accessible and yet highly protected when not in actual use. The smaller and more convenient cameras become for active use-conditions, the more it is necessary to increase the protectiveness and yet accessibility provided by camera cases.

The same factors apply to camcorders. Originally large and heavy, television-compatible camcorders now are approaching the small and convenient size of hand-held still cameras. Because of the small size of both, it is becoming popular for a photographer to carry both a still camera and a camcorder. But they impact against each other in transportation and in use. They tend to impact also with accessories of both. In their compact structure with multiple control features on their surfaces, either or both are subject to impact with ambient objects.

Dropping cameras or camcorders and jostling them around increases with their popularity because more people using them results in their use by more people without camera-handling skills. Camera cases typically do not provide sufficient protection against damage from being dropped and jostled against other objects while providing adequate convenience in being taken in and out of the cases. Camera cases provided by producers and marketers of cameras are not much help for popular use-conditions.

A problem that occurs from small size and weight of one-handed cameras and camcorders is transfer of body movement of an individual to a camera being held. Unsteadiness due to heart-beat and muscular movement can cause distortion in photography. This type of camera movement is known as "camera shake." It occurs also when taking pictures from a moving vehicle. Cushion against camera shake can be made to be cushioning protection against dropping and jostling with this invention. To a degree, it acts as a stand for one-handed photography and for small cameras and camcorders generally.

Camera cases in use that provide the most protection against damage from transportation and use conditions are difficult to take cameras in and out of. Nor do they provide adequate protection against dropping and jostling. Previous efforts to provide camera cases with protection against jostling and dropping have resulted in such large and inconveniently accessible cases that they have not been made adequately protective.

As cameras and camcorders get smaller and lighter, their protection when not in use becomes increasingly significant. Because of their small size and weight, a convenient and suitably cushioned camera case has come into demand. Professional and amateur photographers alike are searching and asking for convenient and cushioned camera cases. It is to fill this demand that this cushioned camera case has been invented.

With this invention, expensive and delicate cameras and camcorders can be tossed and handled almost like a rubber toy when not in actual use. It relieves anxiety of owning, using, transporting, storing and, to a certain extent, lending cameras and camcorders. It is an inexpensive form of damage insurance. Yet it is very convenient because cameras and camcorders can be taken in and out of the case easily. Further, it serves as a cushioned rest for some types of photography with particular types of cameras and matching cases.

SUMMARY OF THE INVENTION

One objective of this invention is to provide a camera case with protection of a camera or a camcorder in it against damage from impact of being dropped.

Another objective of this invention is to provide a camera case with protection of a camera or a camcorder in it against damage from being jostled in transportation and use conditions.

Another objective of this invention is to provide a camera case from which cameras and camcorders can be taken in and out easily and safely.

Another objective of this invention is to provide a camera case with convenient carrying attachments.

Another objective of this invention is to provide a camera case that can be made to provide cushion against camera shake from involuntary body movement.

Another objective of this invention is to provide a camera case that acts as a stand to provide stillness for small cameras and for one-handed photography.

Another object of this invention is to provide protection against adverse weather and other ambient conditions.

Another object of this invention is to provide handle and carrying attachments to a resilient camera case.

Another objective of this invention is to provide rigidity of a camera case with resilient material, rather than with hard material which could harm a camera therein.

Yet another object of this invention is to provide surface area for identification and aesthetics.

This invention accomplishes the above and other objectives with a protective camera case having a tubular body made of thick resilient material without rigid framework and having expansion sections for camera appendages and an easy-open entrance. The tubular body can be cylindrical, rectangular or cubical. The expansion sections can be orifices that are elongated or shaped and positioned for access to particular camera components for allowing certain use of cameras while in the camera cases. This invention can be produced for particular cameras and camcorders or for general use for cameras and camcorders and related items.

Other objects, advantages and capabilities of the invention will become apparent from the following description taken in conjunction with the accompanying drawings showing preferred embodiments of the invention.

BRIEF DESCRIPTION OF THE DRAWINGS

This invention is described by the appended claims in relation to the description of preferred embodiments with reference to the following drawings wherein:

FIG. 7 is a perspective elevation view of another embodiment showing a rectangular or square resilient tube with elongated expansion orifices;

FIG. 8 is a cross-sectional view taken along lines 8—8 of FIG. 7;

FIG. 9 is a cross-sectional view taken along lines 9—9 of FIG. 7;

FIG. 10 is a partial sectional top view of a rectangular or cubical camera case; and FIG. 11 is a perspective elevation view of a camera case sized and shaped to fit particular types of cameras.

DESCRIPTION OF PREFERRED EMBODIMENT

Figure 1:
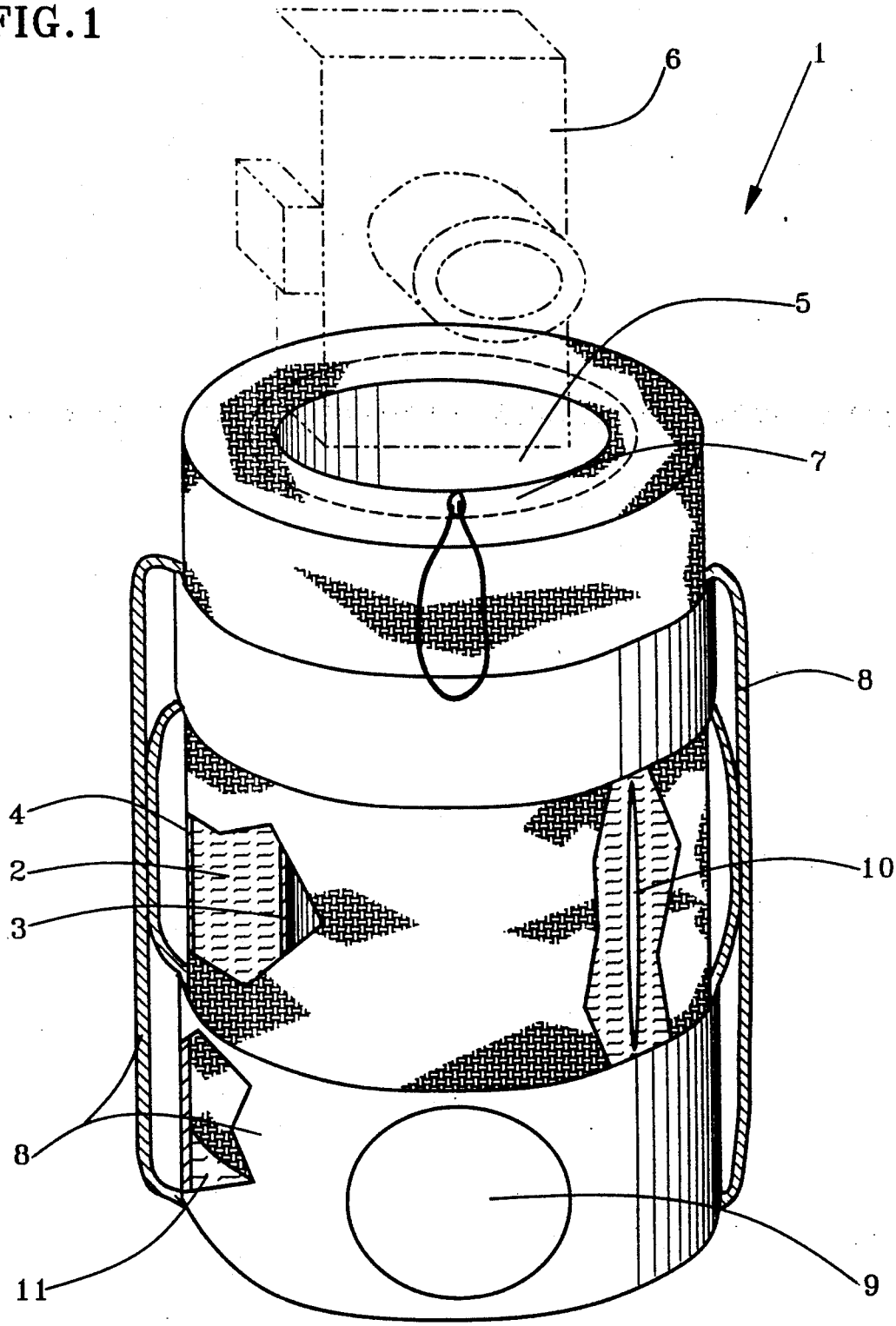
FIG. 1 is a perspective cutaway elevation view in relationship to an outline of a representative camera.
Figure 2:
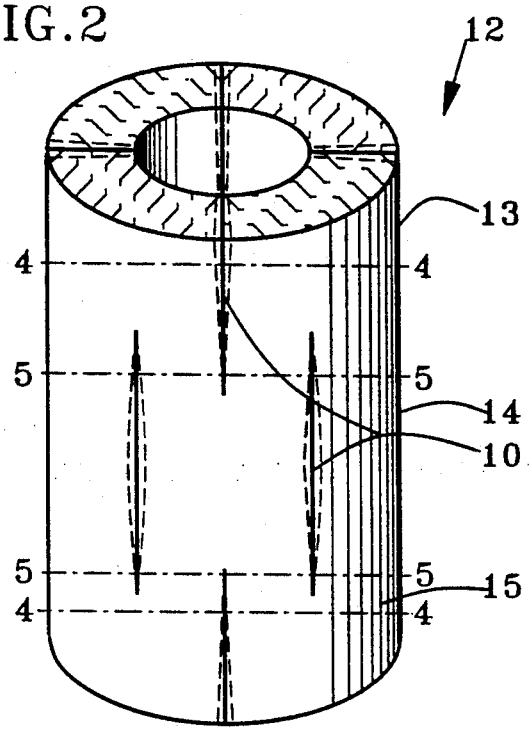
FIG. 2 is a perspective elevation view of a resilient insert.

Referring to the drawings wherein like reference numerals refer to corresponding parts throughout the several figures, the cylindrically tubular camera case 1 has resilient walls 2 with inside lining 3 and outside lining 4. A container cavity 5 in the center of the case 1 is sized to receive a camera 6. A pull-string closure 7 can be employed as a quick-closure means to prevent the camera 6 from falling out of the cavity 5 when the case 1 may be overturned or jostled around. A resilient or otherwise flexible bracket 8 can be attached to the outside lining 4 or otherwise fitted onto the case 1 for carrying it or for attaching carrying straps. A name plate 9 or identification insignia can be positioned on the bracket 8. The bracket 8 can be an aesthetic member in addition to a functional component. Expansion sections 10 are provided at ends and central portions of the resilient walls 2 in order to accommodate projections and corners on cameras 6. A bottom wall 11 made of resilient material serves as a cushion rest for cameras 6 in the case 1.

The resilient walls 2 can be as thick as two inches for some of the larger cases 1 for camcorders and larger cameras 6. For the very smallest cameras 6, the walls can be as thin as three-eighths of an inch. Typically for most cameras, the walls 2 are preferably three-quarters of an inch thick. However, different individuals will prefer thicker walls 2 for some cameras 6 in some use-conditions and thinner walls for other cameras in other use-conditions.

Material for construction of the walls 2 can be foam-rubber insulation tubing or similar raw stock. Compressibility and resiliency of the tubing can vary according to design requirements for particular preferences. Resiliency of three-quarter-inch foam-rubber walls of three-and-one-half-inch outside-diameter conventional insulation tubing is recommended for walls 2 for most small cameras for typical use-conditions.

Figure 3:
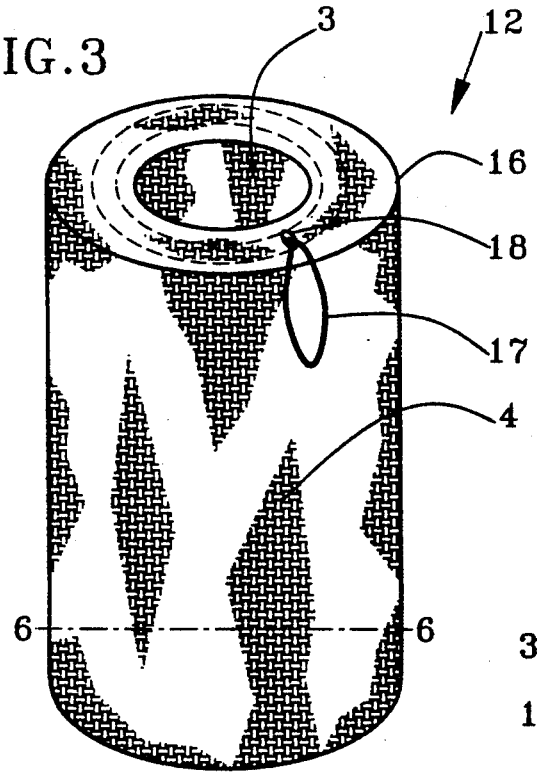
FIG. 3 is a perspective elevation view of the FIG. 2 resilient insert with a lining material on it.

Referring to FIGS. 2–6, the walls 2 can be in a resilient insert 12 having expansion sections 10 in the form of slits in a top section 13, a mid section 14 and a bottom section 15. The expansion section can overlap at the mid section 14 in different circumferential positions. As illustrated in FIG. 3, inside lining 3 and outside lining 4 on the insert 12 can converge at a closure end 16 where a pull-string 17 can be positioned selectively in a pull-string enclosure 18.

Figure 4:
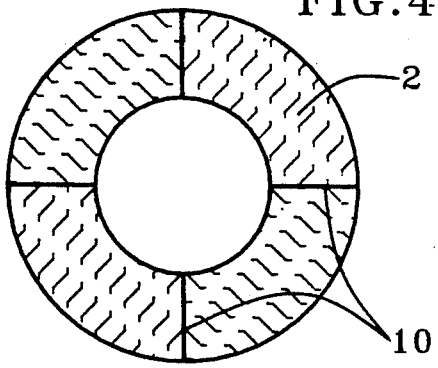
FIG. 4 is a cross-sectional view taken along lines 4—4 of FIG. 2.
Figure 5:
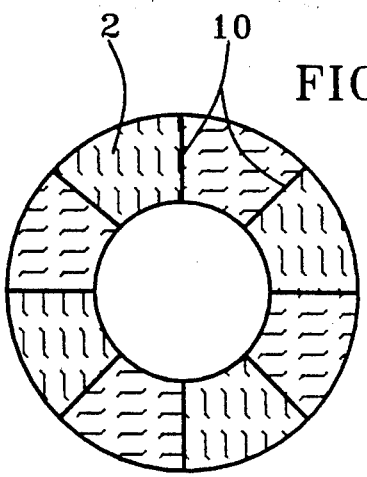
FIG. 5 is a cross-sectional view taken along lines 5—5 of FIG. 2.

Expansion sections 10 in the form of slits in walls 2 at ends 13 and 14 are shown at cross sections in FIG. 4. The cross section is indicated as section lines 4—4 in FIG. 2. Overlap of the expansion sections 10 is shown by section line 5—5 in FIG. 2 and in FIG. 5.

Figure 6:
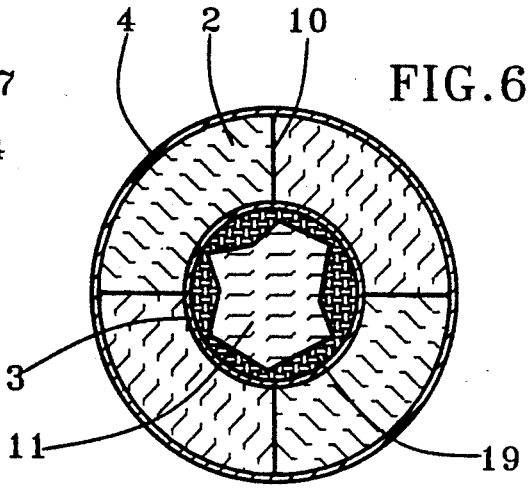
FIG. 6 is a cross-sectional view taken along lines 6—6 of FIG. 3.

FIG. 6 shows the components of FIG. 3 at cross section 6—6. Included are outside lining 4, resilient walls 2, expansion sections 10, inside lining 3, an inside bottom lining 19 and resilient bottom wall 11.

The resilient walls 2 in FIG. 2 and FIGS. 4–6 are illustrated with flex cross hatching in different angles. This demonstrates that the walls 2 can be attached sections of tubing or different portions of an extruded tubing, depending on design preferences.

Reference is made now to FIGS. 7–10. A rectangular resilient insert 20 shown in FIG. 7 can be utilized for a rectangular or cubical camera case 21 shown from a top view in FIG. 10. Similar to the resilient walls 2 for the cylindrical embodiment of this invention, rectangular walls 22 can be provided with expansion sections 10 at top end 23, mid section 24 and bottom end 25. A pull-string enclosure 18 with pull string 17 is attached to inside walls 3 and outside walls 4 of liner material. Walls 22 can be joined or extruded as a rectangular tube, similar to the cylindrical tube for cylindrical tubular camera case 1.

As illustrated in FIG. 11, a form-cushioned camera case 26 can be constructed to fit particular cameras and camcorders as another embodiment of this invention. It can have a cushion lid 27 with an optional view orifice 28 for projections such as a view lens. The lid 27 can be attachable with a hinge 29 or other optional means for attachment to the case 26. In addition to lid 27, an optional enclosure orifice 30 can be provided for taking a camera or camcorder in and out of form-cushioned camera case 26. Expansion sections 10 in the tubular embodiments of this invention are in the form of view-lens lid 27 and camera-lens cover 31. Lens-cover hinge 32 or other attachment means can be employed to attach lens cover 31 to the case 26. For embodiments of this invention featuring the capability of operating cameras and camcorders in the case 26, it is preferable to have operable communication with a shutter switch or other actuation means through a switch orifice 33 in resilient construction material 34. The lens cover 31 can have a lens-cover orifice 35 in lieu of or in addition to lens-cover hinge 32. Size, shape and positioning of expansion orifices such as lens cover 31, view-lens lid 27 and switch orifice 33 must be matched to particular cameras and camcorders for in-case-operability embodiments of this invention.

Various modifications may be made of the invention without departing from the scope thereof and it is desired, therefore, that only such limitations shall be placed thereon as are imposed by the prior art and which are set forth in the appended claims.

I claim:

1. A cushioned camera case comprising:

a tubular body made of thick resilient material without rigid framework, expansion sections for camera component appendages; a fixed base end; wherein the expansion sections for camera component appendages are slits of select lengths positioned in walls of the tubular body; and an easy-open entrance at an opposite end from the fixed base end.

2. A cushioned camera case according to claim 1 wherein the thick resilient material with which the tubular body is constructed is foam rubber.

3. A cushioned camera case according to claim 1 wherein the thick resilient material with which the tubular body is constructed is foam rubber having a thickness not less than three-eighths of an inch and not greater than one inch.

4. A cushioned camera case according to claim 1 wherein the thick resilient material with which the tubular body is constructed is foam rubber having a desired compressive yield resistance.

5. A cushioned camera case according to claim 1 wherein the tubular body is cylindrical.

6. A cushioned camera case according to claim 1 wherein the tubular body is selectively cubical.

7. A cushioned camera case according to claim 6 wherein the fixed base end is a resilient material.

8. A cushioned camera case according to claim 1 wherein the tubular body is sized and shaped to match particular cameras to be inserted therein.

9. A cushioned camera case according to claim 8 wherein the expansion sections for camera component appendages are openable as orifices sized and positioned to allow access through the resilient material to select components of a camera positioned in the cushioned camera case.

10. A cushioned camera case according to claim 9 wherein the expansion sections for camera component appendages openable as orifices are sized and positioned to allow access through the resilient material to at least a focussing view lens and a shutter switch of a camera positioned in the cushioned camera case.

11. A cushioned camera case according to claim 8 wherein a select portion of the expansion sections for camera component appendages are openable as orifices sized and positioned to allow access through the resilient material to select components of a camera positioned in the cushioned camera case.

12. A cushioned camera case according to claim 1 wherein the tubular body is cylindrical.

13. A cushioned camera case according to claim 1 wherein the tubular body is selectively cubical.

14. A cushioned camera case according to claim 1 wherein the fixed base end is a resilient material.

15. A cushioned camera case according to claim 1 wherein the fixed base end is a resilient material.

16. A cushioned camera case according to claim 1 and further comprising a lining material on walls of an inside periphery of the cushioned camera case.

17. A cushioned camera case according to claim 16 wherein the easy-open entrance is a pull-string entrance closure attached to the lining material.

18. A cushioned camera case according to claim 1 and further comprising a lining material on walls of an outside periphery of the cushioned camera case.

19. A cushioned camera case according to claim 18 wherein the easy-open entrance is a pull-string entrance closure attached to the lining material.

20. A cushioned camera case according to claim 1 and further comprising a lining material on walls of inside and outside peripheral surfaces of the cushioned camera case.

21. A cushioned camera case according to claim 20 wherein the easy-open entrance is a pull-string entrance closure attached to the lining material on both the inside and outside peripheral surfaces of the cushioned camera case.

22. A cushioned camera case according to claim 1 and further comprising a resilient-strap bracket positionable on the outside periphery of the cushioned camera case.

23. A cushioned camera case according to claim 22 and further comprising an identification and aesthetics surface on the resilient-strap bracket.

* * * * *